US006546870B2

(12) United States Patent
Mayer et al.

(10) Patent No.: US 6,546,870 B2
(45) Date of Patent: Apr. 15, 2003

(54) METHOD FOR CONTROLLING A QUANTITY OF INK IN A PRINTING MACHINE

(75) Inventors: Martin Mayer, Ladenburg (DE); Nikolaus Pfeiffer, Heidelberg (DE)

(73) Assignee: Heidelberger Druckmaschinen AG, Heidelberger (DE)

( * ) Notice: Subject to any disclaimer, the term of this patent is extended or adjusted under 35 U.S.C. 154(b) by 0 days.

(21) Appl. No.: 09/730,274

(22) Filed: Dec. 5, 2000

(65) Prior Publication Data

US 2001/0002577 A1 Jun. 7, 2001

(30) Foreign Application Priority Data

Dec. 6, 1999 (DE) ..... 199 58 654

(51) Int. Cl.[7] ..... B41F 31/02
(52) U.S. Cl. ..... 101/483; 101/365
(58) Field of Search ..... 101/364, 483, 101/484, 365, 366

(56) References Cited

U.S. PATENT DOCUMENTS 3,835,777 A * 9/1974 Krygeris ..... 101/350.4
5,170,711 A 12/1992 Maier et al. ..... 101/365
5,524,542 A * 6/1996 Toyama ..... 101/365
6,318,260 B1 * 11/2001 Chu et al. ..... 101/365

FOREIGN PATENT DOCUMENTS

DE 39 07 584 A1 9/1990
DE 43 37 343 A1 5/1995
DE 197 01 219 A1 7/1998
EP 0 881 076 A1 12/1998
GB 2352683 A * 7/2001 ..... B41F/31/02

OTHER PUBLICATIONS

Mizuno et al., Ink Supply Adjusting Device of Printer, Feb. 1991, Japanese abstract, 03–027944.*

H.J. Schmitt: "Steuerung Der Farbdosierung Bei Offsetdruckwerken Durch Rechnergestützte Modellvorhersagen" [controlling the ink amount in offset printworks by using computer supported model forecasts], *PDV–Verichte, KfK –PDV 178, Dec. 1979, pp. 24–43.*

* cited by examiner

*Primary Examiner*—Daniel J. Colilla
(74) *Attorney, Agent, or Firm*—Laurence A. Greenberg; Werner H. Stemer; Ralph E. Locher

(57) ABSTRACT

A method for controlling an ink quantity in different zones of an ink roller in a printing machine, which includes prescribing nominal values of the ink quantity for each zone. A value of the ink quantity flow released for the zone by an ink source corresponds to each nominal value of the ink quantity. The nominal value for a given zone is changed from a first value to a second value, the ink quantity in the given zone is changed by prescribing a first correction ink quantity flow. The method further includes prescribing additional correction ink quantity flows for zones situated adjacent the given zone and, during a transition interval, setting the ink quantity flow for each of the zones situated adjacent the given zone to the sum of the correction ink quantity flow and the ink quantity flow corresponding to the nominal value of the given zone.

11 Claims, 3 Drawing Sheets

METHOD FOR CONTROLLING A QUANTITY OF INK IN A PRINTING MACHINE

BACKGROUND OF THE INVENTION

Field of the Invention

The invention relates to a method for controlling a quantity of ink located on an ink roller of a printing machine during the processing of a printing job. The larger this ink quantity is, the more intense the tinting or coloration thereof is. It is therefore important to keep this ink quantity constant as long as the print result is satisfactory with respect to the tinting or color thereof, and to be able to adjust the ink quantity to a new value as quickly as possible, if color deviations are discovered, it being expected that the new value would be able to deliver a satisfactory inked printing result.

The inking unit of a printing machine typically includes an ink source, potentially in the form of an ink fountain or duct having a metering device, and a transport device, which includes a greater or lesser number of ink rollers and which feeds the ink quantity flow that is apportioned by the ink source to the printing form. Printing machines for high-quality ink printing allow an independent control of such an ink roller, respectively, zonally. Printing machines with this characteristic are described in the published German Patent Documents DE 40 04 056 A1, DE 37 07 685 A1 and DE 197 27 387 C1, for example. In this way, zones of the ink roller that serve for inking zones of the printing form having a high ink consumption are inked more intensely than those zones having a low consumption. In order to set the ink quantity on a zone of the ink roller to a new value, it is necessary to vary the ink quantity flow that is released for this zone from the ink source. Because this ink quantity flow is distributed to a large number of rollers before reaching the printing form, a fairly long time passes between a modification of the desired or nominal value of the ink quantity and a corresponding resetting of the metering device, on one hand, and the time at which the modified proportion influences the quantity of ink on the roller and thus the ink supply to the printing form. During this time, spoilage is produced.

It is therefore highly desirable to keep this time as short as possible. To this end, applicants have developed a method by which, when the desired or nominal value of the ink quantity for a zone of the roller is changed from a first value to a second value, a first correction ink quantity flow is prescribed, and during a transition interval, the ink quantity flow for this zone is set to the sum of the correction ink quantity flow and the ink quantity flow corresponding to the second desired or nominal value. When the second desired or nominal value is greater than the first, the correction ink quantity flow is positive, and when the second desired or nominal value is less than the first, the correction ink quantity flow is negative. This means that ink which is sufficient for a time, i.e., too little ink, is fed from the ink source, in order to obtain the desired or nominal quantity of ink on the ink roller as rapidly as possible, and after the expiration of a time-span after which this second ink quantity should have been approximately attained, there is a changeover to the ink quantity flow corresponding to the second ink value, which is dimensioned so that the second ink quantity is maintained on the roller in continuous operation.

This method has been used in the inking units of Heidelberger Druckmaschinen A.G. of Heidelberg, Germany since 1986. A corresponding method is also described in the published German Patent Document DE 43 37 343 A1. The application of similar methods for dampener control in an offset printing machine has become known heretofore from the published German Patent Documents DE 39 07 584 A1 and DE 197 01 219 A1.

A problem arises in the control of the ink quantity zonally in that when the desired or nominal value of the ink quantity flow that is released by the ink source for one zone is changed, not only the ink supply of the corresponding zone of the printing form is changed, but also that of neighboring zones. The reason for this is that the ink in the inking unit of the printing machine is distributed, so that an exchange of ink takes place between different zones.

The ink exchange between the zones prolongs the time until a steady state sets in again in the affected zone and the neighboring zone subsequent to modification of a desired or nominal value.

Another problem of the conventional ink quantity regulation by a correction ink quantity flow is that, for a sharp reduction of the desired or nominal value of the ink quantity, the correction ink quantity flow is so intensely negative that the sum of the correction ink quantity flow and the ink quantity flow corresponding to the second desired or nominal value, a sum which must be set during the transition time interval, is less than zero. Such a negative ink quantity flow would correspond to the uptake of ink from the inking unit by the ink source and cannot be realized using conventional ink sources. It therefore takes a particularly long time before a new desired or nominal value for the ink quantity of a zone actually to be attained in this case.

A similar problem arises when the desired or nominal value of the ink quantity is increased. The greatest possible ink quantity flow that the ink source can apportion in one zone is limited, and it is conceivable that when the desired or nominal value of the ink quantity flow is increased, the sum of the correction ink quantity flow and the ink quantity flow corresponding to the second desired or nominal value, a sum which is set during the transition interval, is greater than the maximum quantity of ink that can be apportioned. In this case, as well, the new desired or nominal ink quantity is attained only with a considerable delay.

SUMMARY OF THE INVENTION

It is accordingly an object of the invention to provide a method for controlling ink quantity in different zones of an ink roller which allows a rapid setting of a new desired or nominal value of the ink quantity even in the foregoing cases; is i.e., a method by which a zone for which the desired or nominal value of the ink quantity has been changed and the neighboring zones thereof attain stationary ink quantities as rapidly as possible.

With the foregoing and other objects in view, there is provided, in accordance with the invention, a method for controlling an ink quantity in different zones of an ink roller in a printing machine, nominal values of the ink quantity for each zone being prescribed in a time-dependent manner, and a value of the ink quantity flow released for the zone by an ink source corresponding to each nominal value of the ink quantity, whereby, when the nominal value for the zone remains constant, a constant ink quantity is maintained in the respective zone by a release from the ink source of an ink quantity flow corresponding to the nominal value, and in the event the nominal value for a given zone is changed from a first value to a second value, the ink quantity in the given zone is changed in that a first correction ink quantity flow is prescribed in accordance with a given rule dependent upon the first and the second nominal values and, during a transition interval, the ink quantity flow for the given zone is set to the sum of the first correction ink quantity flow and the ink quantity flow corresponding to the second nominal value, which comprises prescribing additional correction ink quantity flows for the zones situated adjacent the given zone and, during the transition interval, setting the ink quantity flow for each of the zones situated adjacent the given zone to the sum of the correction ink quantity flow and the ink quantity flow corresponding to the nominal value of the given zone.

In accordance with another mode, the method includes imposing a condition for prescribing the additional correction ink quantity flows that the difference between the first and the second nominal values exceeds a limit value.

In accordance with a further mode, the method includes imposing a condition for prescribing the additional correction ink quantity flows that the sum of the correction ink quantity flow and the ink quantity flow for the given zone, which corresponds to the second nominal value, is outside of a limit value.

In accordance with an added mode, the method includes imposing a condition for prescribing the additional correction ink quantity flows that the sum of the correction ink quantity flow and the ink quantity flow for the given zone, which corresponds to the second nominal value, exceeds an upper limit value.

In accordance with an additional mode, the method includes imposing a condition for prescribing the additional correction ink quantity flows that the sum of the correction ink quantity flow and the ink quantity flow for the given zone, which corresponds to the second nominal value, falls short of a lower limit value.

In accordance with yet another mode of the method invention, the lower limit value for the ink quantity flow is when the ink zones are closed.

In accordance with yet a further mode of the method invention, the upper limit is the maximum ink quantity meterable for the given zone from the ink source.

In accordance with yet an added mode of the method invention, the correction ink quantity flows, respectively, are constant in the transition interval.

In accordance with yet an additional mode, the method includes providing that the ratio of the additional correction ink quantity flows to the first correction ink quantity flow is defined to be greater, the more intense the lateral distribution or rubbing of the ink in the printing machine is.

In accordance with a concomitant mode, the method includes providing that the ratio of the additional correction ink quantity flows to the first correction ink quantity flow is defined to be greater, the smaller the area covered by the zones which are allocated to the correction ink quantity flows.

The additional correction ink quantity flows expediently have the same operational sign and a smaller absolute value than the first correction ink quantity flow. The ratio of the ink quantity flows is advantageously defined in dependence upon the intensity of the distribution or rubbing of the ink in the inking unit; and namely, this ratio is larger, the more intense the distribution or rubbing is, and the smaller the area covered, i.e., the more intense the ink exchange between zones is.

In order to keep the control of the method simple, it can be provided, as a condition of prescribing the additional correction ink quantity flows, that the difference between the first and second desired or nominal values exceeds a limit value. The underlying idea of this is that when the difference in desired values is small, the ink modification in the affected zone is small, and consequent changes in the ink quantities in neighboring zones will barely be perceptible and will not have any noticeable influence on the printing results.

Alternatively or in addition, it can be provided, as a condition of prescribing the additional correction ink quantity flows, that the sum of the first correction ink quantity flow and the ink quantity flow corresponding to the second desired or nominal value for the given zone exceeds an upper limit value or falls short of a lower limit value. The lower limit can be zero, and the upper limit can be the maximum ink quantity flow that can be apportioned or metered for the given zone from the ink source.

A simple control is also achieved in that the correction ink quantity flows are each constant during the transition interval. The duration of the transition interval can be defined at a fixed value, particularly a value that is independent of the first and second desired or nominal values of the ink quantity.

Other features which are considered as characteristic for the invention are set forth in the appended claims.

Although the invention is illustrated and described herein as a method for controlling a quantity of ink in a printing machine, it is nevertheless not intended to be limited to the details shown, since various modifications and structural changes may be made therein without departing from the spirit of the invention and within the scope and range of equivalents of the claims.

The method of operation of the invention, however, together with additional objects and advantages thereof will be best understood from the following description of specific modes when read in connection with the accompanying drawings, wherein:

DESCRIPTION OF THE PREFERRED MODES OF THE METHOD

Figure 1:
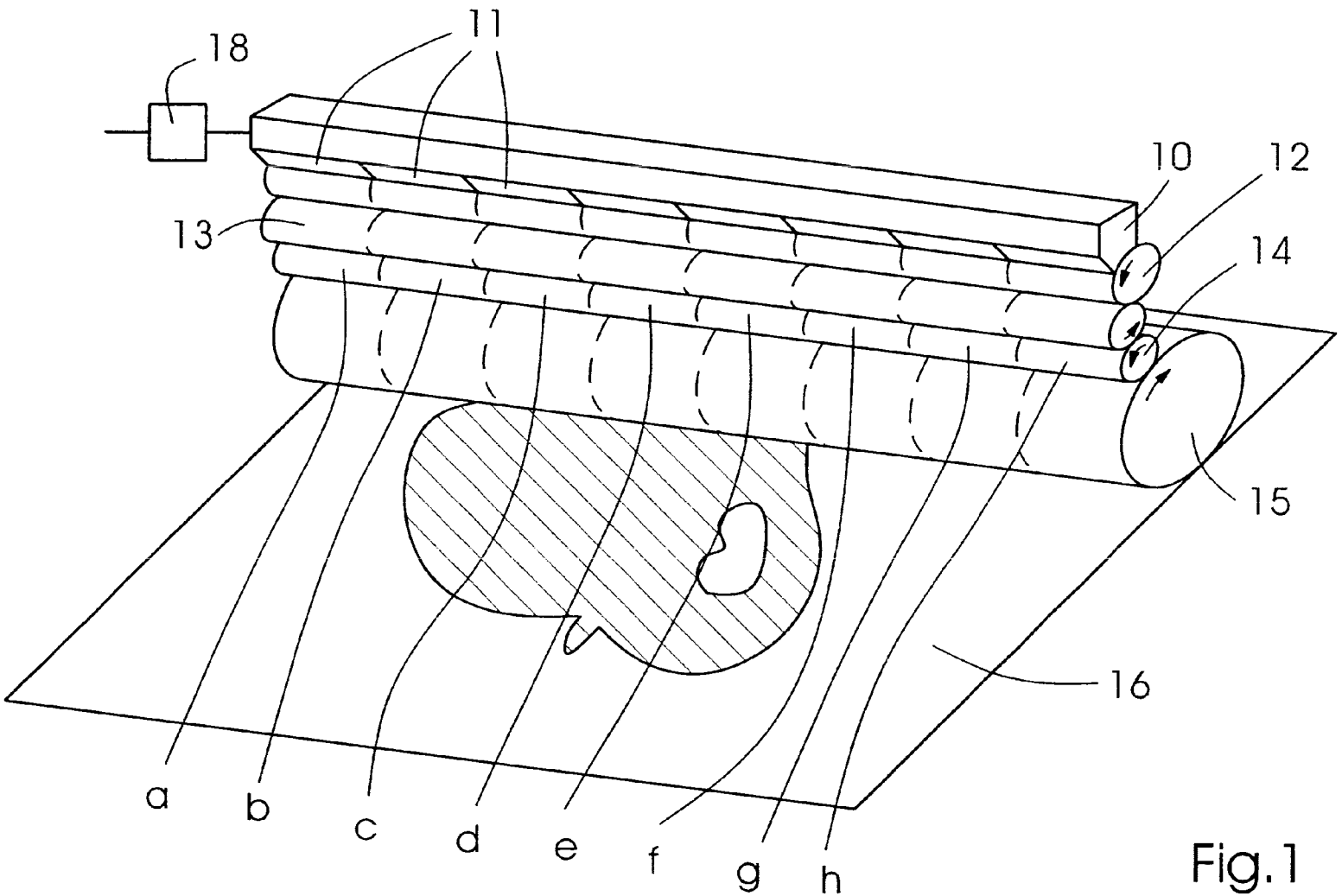
FIG. 1 is a fragmentary, highly diagrammatic and schematic front, top and side perspective view of a printing machine suitable for performing the method according to the invention.

Referring now to the drawings and, first, particularly to FIG. 1 thereof, there is shown therein diagrammatically and schematically a section of a printing machine for performing the method according to the invention. The printing machine includes an ink fountain 10 as ink source for dispensing ink zonally, which has a plurality of doctor blades disposed in a staggered manner over the width of the ink fountain 10. To each doctor blade 11, a respective non-illustrated positioning servomotor is allocated, which adjusts the width of a metering or apportioning gap or the pressing force of the respective doctor blade 11 against a roller 12 in accordance with a signal for a desired or nominal value of ink quantity flow that is provided for each doctor blade 11 by a control circuit 18. These doctor blades 11 and the positioning servomotors therefor function as actuators by the aid of which it is possible to adjust the ink quantity flow that is released by the ink fountain 10 for a given zone.

The roller 12 releases part of the ink quantity flow to another roller 13 whereon the first roller 12 rolls. A residual portion of the ink quantity flow, the size of which can vary with changing operating conditions of the printing machine, is transported back to the ink fountain by the roller 12. The apportioned or metered ink quantity flow thus does not correspond to the actual ink consumption of the printing machine.

Instead of the ink fountain 10 shown here, a conventional structure that has a vibrator roller oscillating between a fountain roller or ductor and a first inking unit roller can also be provided as ink source. In this case, the ink quantity flow can be proportioned not only by adjusting ink zone openings as described above, but also by adjusting the ink stripe width on the vibrator roller. Here, too, only a part of the apportioned or metered ink quantity flow is transported into the inking unit, and the remainder remains on the vibrator roller and is returned to the fountain roller by the oscillating motion of the vibrator roller. The inking unit includes a great number of rollers, three rollers 12, 13, and 14 of which are represented in FIG. 1, which is an idealized representation in this regard, the rollers 12, 13 and 14 serving to divide, distribute by rubbing, and emulsify the ink with a dampening agent that is supplied by a non-illustrated dampening unit, and finally to transport the emulsified ink to a printing form 15. In correspondence with the doctor blades 11, the rollers 12, 13 and 14 and the printing form 15 have respective zones a, b, c, . . . h which draw their ink, for the most part, from the doctor blade of the ink fountain 10 that is associated therewith.

A printing material sheet 16 with a printed image is also shown in FIG. 1.

Figure 2A:
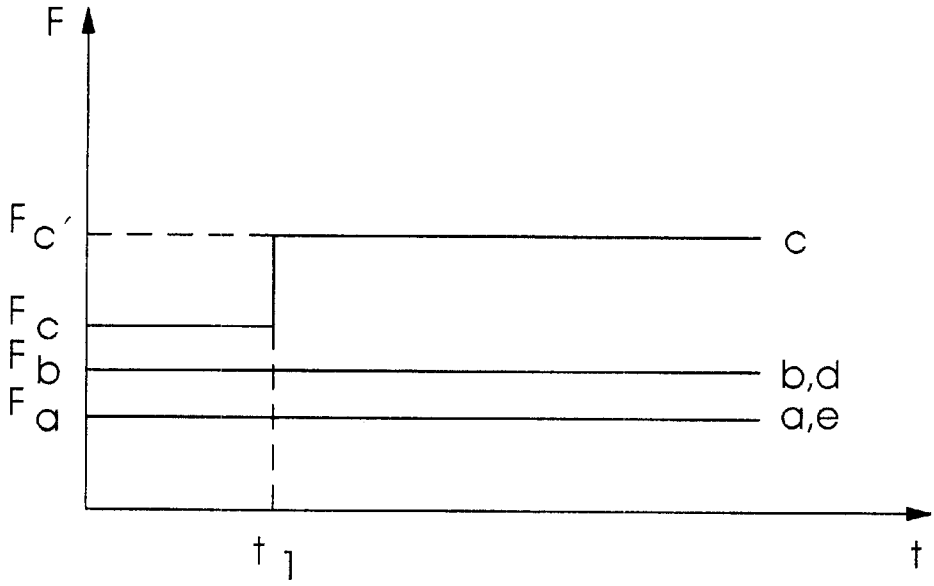
FIGS. 2*a* and 2*b* are plot diagrams of the time characteristics or time rates of change of desired or nominal values of ink quantity and of ink quantity flow, respectively, according to a first exemplifying mode of the method.
Figure 2B:
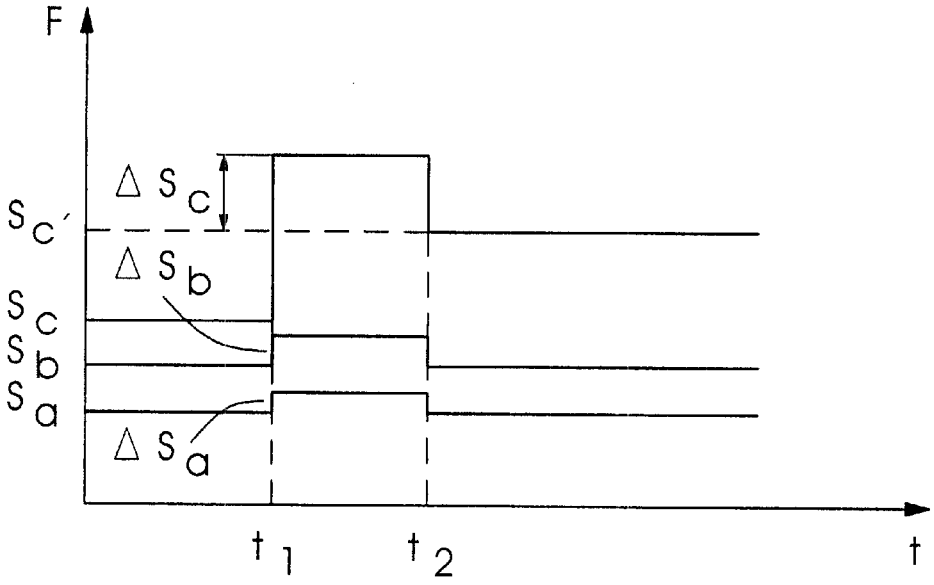

FIGS. 2*a* and 2*b* show two diagrams, respectively, of a single time characteristic or time rate of change of desired or nominal values of the ink quantity F for different zones, which are applied to the control circuit 18 from the outside, as well as for the ink quantity flows S for the applicable segments, which are set by the control circuit at the corresponding doctor blades 11.

FIG. 2*a* represents the case wherein the desired ink quantity of zone c at time $t_1$ is being adjusted from a desired or nominal value $F_c$ to a new desired or nominal value $F_c'$. The desired values $F_b$ and $F_a$ are in effect for the immediately adjacent zones b and d, and a and e, respectively; these remain constant throughout this process.

Proportional settings $s_c$, $s_c'$, $s_b$, $s_a$ of the ink quantity flow that is released for the zones c, b and d, on the one hand, and for zones a and e, on the other hand, correspond to the desired or nominal values of the ink quantity, it being noted that, in the given example, the desired or nominal values for zones b and d, on the one hand, and zones a and e, on the other hand, are equal merely in the interest of simplicity.

At the time $t_1$, the control circuit for the relevant zones c, b and d, on the one hand, and a and e, on the other hand, prescribes correction ink quantity flows $\Delta s_c$, $\Delta s_b$, $\Delta s_a$ and sends control signals to the ink source/ink quantity flow that respectively correspond to the sum of the correction ink quantity flow and the ink quantity flow corresponding to the current desired or nominal value for the ink quantity.

The ratio of the correction ink quantity flows to one another corresponds to the extent of the distribution of the inks in the inking unit and to the zonal area coverage. The dependency upon the area coverage stems from the fact that the smaller the area coverage is, the greater the average dwell period of the ink in the inking unit. As the dwell time of the ink increases, the number of the crossings thereof through distributing or rubbing gaps of the inking unit also increases. The more intense the rubbing or distribution is, or the smaller the area coverage, the smaller the difference in size is between the ink quantity correction flow of zone c, which is affected by the modification of the desired or nominal value, and those of the immediately adjacent zones b and d, on the one hand, and of the zones a and e, on the other hand, which are adjacent the immediately adjacent zones.

When the transition time interval expires at the time $t_2$, ink quantity flows corresponding to the current desired or nominal value for the ink quantity $F_c'$, $F_b'$, $F_a'$ are set for each zone. The ink quantity flows of the zones a, b, d, e have not been modified; however, the result of the heavier ink supply of zone c is that these zones an the last roller 14 also carry more ink than prior to the modification of the ink quantity of zone c. As a result of the temporary increasing of the ink quantity flows for these neighboring zones, as well, the new stationary ink quantity of these zones is attained more rapidly than would be possible if only the ink quantity of zone c were controlled and if the time were waited out until the new stationary ratios also set in, as a consequence of the distribution or rubbing, in the neighboring zones.

Figure 3A:
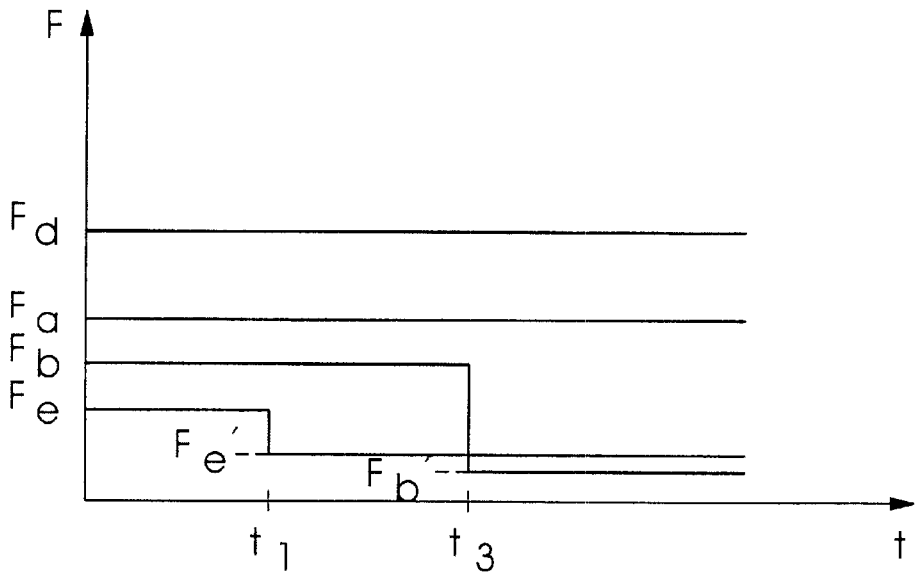
FIGS. 3*a* and 3*b* are plot diagrams of the time characteristics or time rates of change of desired or nominal values of ink quantity and of ink quantity flow, respectively, according to a second exemplifying mode of the method.
Figure 3B:
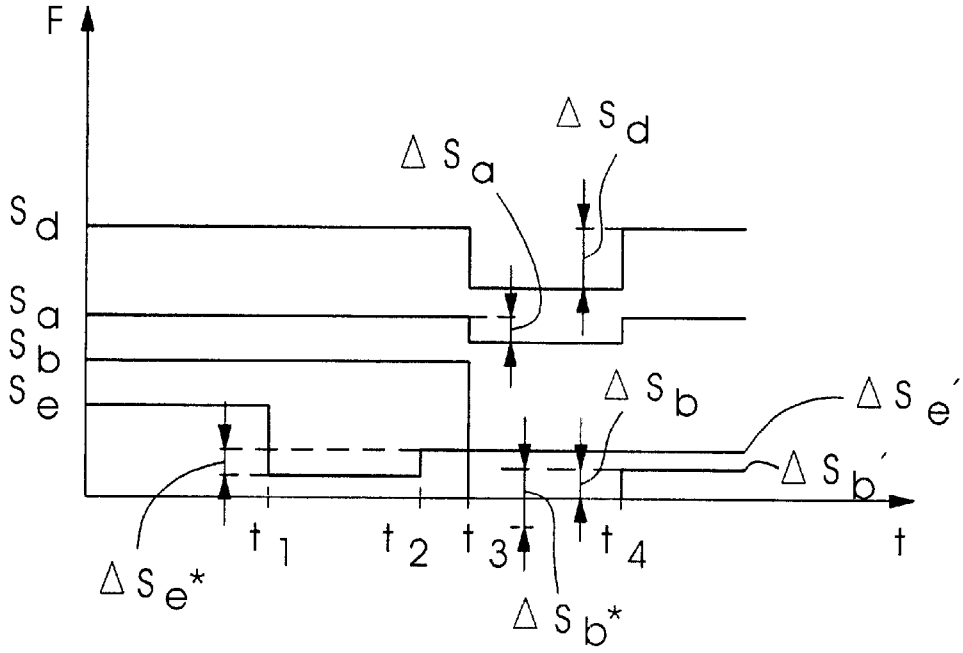

FIGS. 3*a* and 3*b*, respectively, show an example of a second application of the method according to the invention, again with reference to two plot diagrams, one of which represents the desired or nominal values of ink quantity F for the zones a to e to be adjusted on the roller 14, that value being prescribed to the control circuit 18 from the outside, as a function of time, and the other of which represents the values of ink quantity flow s for the same zones, the ink quantity flow values being outputted to the ink source 10 by the control circuit 18 in response to the prescription of the desired or nominal value, likewise as a function of time.

As is apparent from the first diagram, from t=0 to $t=t_1$, desired or nominal ink quantities $F_a$, $F_b$, $F_c$, $F_d$, $F_e$ are in effect for the relevant zones a to e (in the interest of a simpler description and a better overview, the same ink quantity is assumed for zones a and c). At the time $t_1$, a new ink quantity $F_e'$ is prescribed for zone e. The control circuit 18 calculates the ink quantity flow $s_e'$ that must be delivered into zone e by the ink source so that the ink quantity $F_e'$ sets in under constant operating conditions. The control circuit 18 also calculates a correction ink quantity flow $\Delta s_e^*$ with the aid of the two ink quantities $F_e$, $F_e'$ or, to the same result, with the aid of the ink quantity flows $s_e$, $s_e'$:

$$\Delta s_e^* = f(F_e, F_e')$$

The function f is positive when $F_e$ is less than $F_e'$; in the case at hand, it is negative.

During a transition interval lasting from $t_1$ to $t_2$, the control circuit releases from the ink source a desired or nominal value of ink quantity flow for zone e, which is defined by the sum of $s_e'$ and $\Delta s_e^*$. Starting from the time $t_2$, the previously calculated value $s_e'$ is set. Because the desired or nominal value difference is less than a limit value, nothing is altered in the adjacent zones.

This procedure still corresponds to the conventional control process. At time $t_3$, however, the value of the ink quantity $F_b$ that is prescribed for zone b is changed so sharply to a new value $F_b'$ that this conventional type of control reaches its limits. Here, the difference $F_b-F_b'$ is so great that, in absolute terms, the correction ink quantity flow $\Delta s_b'$ that was calculated with the aid of the same function f as before is greater than the ink quantity flow $s_b'$ that corresponds to the new ink quantity $F_b'$ in continuous operation. The correction ink quantity flow would thus have to become negative during the transition time interval $t_3$ to $t_4$, which is only possible to a limited extent. Therefore, in order, nevertheless, to attain the new ink quantity in zone b during the transition interval, the ink quantity flow for zone b is set to 0 during the transition interval; i.e., the ink source does not deliver any more ink into this zone, and at the same time the ink quantity flow for the adjacent zones is also reduced. In this regard, the reduction is selected so that the sum of the correction ink quantity flows, by which the ink quantity in the neighboring zones a, c, d is reduced, corresponds precisely to the error that arises in the control of the ink quantity flow in zone b due to an inability to set a negative ink quantity flow, though in any case an ink quantity flow of 0 can be set. In other words:

$$\Delta S_b^*-\Delta S_b=\Delta S_a+\Delta S_c+\Delta S_d.$$

As in the example at hand, the correction ink quantity flows of the neighboring zones are smaller, the farther removed these zones are from the zone that is affected by the redefining of the ink quantity.

In this example, additional correction ink quantity flows are prescribed only for the directly adjacent zones and the zones adjacent to the directly adjacent zones, but not for zone e, which is farther removed from the affected zone. In practice, the number of neighboring zones for which correction ink quantity flows are prescribed can of course be greater or can be limited to the immediately adjacent zones.

Of course, control of the ink quantity flow in the manner described with reference to FIG. 3 is possible only when the ink quantity flow that must be released during the transition interval is less than 0. In principle, an arbitrary limit value can be defined, the failure to exceed which results in the ink quantity flow being reduced not only in the zone that is affected by the redefining of the ink quantity but also in adjacent zones.

A similar control is possible if a raising of the desired value of ink quantity during the transition interval would necessitate the setting of an ink quantity flow that is too large to be able to be correctly apportioned or metered by the ink quantity.

In another mode of the method, only the absolute value of the correction ink quantity flow $\Delta s^*$ that is calculated with the aid of the function f is evaluated, and if this is greater than a limit value, the calculated correction ink quantity flow is distributed to several zones:

$$\Delta S' = \sum_i \Delta s_i,$$

the sum being taken over the zone that is affected by the redefining of the ink quantity and the neighboring zones thereof. When the correction ink quantity flow is less than the limit value, it is assumed that modifications in the ink quantity of the relevant zone will not lead to noticeable consequent changes in neighboring zones, and that it is therefore sufficient to change the ink quantity flow only for the relevant zone itself.

We claim:

1. A method for controlling an ink quantity in different zones of an ink roller in a printing machine, which comprises:

presetting first nominal values of the ink quantity for each zone in a time-dependent manner, each first nominal value of the ink quantity corresponding to a value of ink quantity flow released for the respective zone by an ink source;

maintaining a constant ink quantity in the respective zone by releasing an ink quantity flow from the ink source corresponding to the first nominal value for a zone, upon the first nominal value for the zone remaining constant;

changing the ink quantity in a given zone upon a nominal value for the given zone being changed from the first nominal value to a second nominal value, and performing the step of changing the ink quantity in the given zone by:

determining a first correction ink quantity flow in accordance with a given rule dependent upon the first and the second nominal values; and during a transition interval, setting the ink quantity flow for the given zone to the sum of the first correction ink quantity flow and an ink quantity flow corresponding to the second nominal value;

determining additional correction ink quantity flows for the zones situated adjacent the given zone; and during the transition interval, setting the ink quantity flow for each of the zones situated adjacent the given zone to the sum of the respective additional correction ink quantity flow and the ink quantity flow corresponding to the second nominal value of the respective zone of zones situated adjacent the given zone.

2. The method according to claim 1, which includes determining the additional correction ink quantity flows upon the difference between the first and the second nominal values exceeding a limit value.

3. The method according to claim 2, which includes determining the additional correction ink quantity flows upon the sum of the first correction ink quantity flow and the ink quantity flow for the given zone, which corresponds to the second nominal value, being outside of a limit value.

4. The method according to claim 1, which includes determining the additional correction ink quantity flows upon the sum of the first correction ink quantity flow and the ink quantity flow for the given zone, which corresponds to the second nominal value, being outside of a limit value.

5. The method according to claim 4, which includes determining the additional correction ink quantity flows upon the sum of the first correction ink quantity flow and the ink quantity flow for the given zone, which corresponds to the second nominal value, exceeding an upper limit value.

6. The method according to claim 5, wherein the upper limit is the maximum ink quantity meterable for the given zone from the ink source.

7. The method according to claim 4, which includes determining the additional correction ink quantity flows upon the sum of the first correction ink quantity flow and the ink quantity flow for the given zone, which corresponds to the second nominal value, falling below of a lower limit value.

8. The method according to claim 7, wherein the lower limit value for the ink quantity flow is when the ink zones are closed.

9. The method according to claim 1, wherein the correction ink quantity flows, respectively, are constant in the transition interval.

10. The method according to claim 1, which includes providing that the ratio of the additional correction ink quantity flows to the first correction ink quantity flow is defined to be greater, the more intense the lateral distribution or rubbing of the ink in the printing machine is.

11. The method according to claim 1, which includes providing that the ratio of the additional correction ink quantity flows to the first correction ink quantity flow is defined to be greater, the smaller the area covered by the zones which are allocated to the correction ink quantity flows.

* * * * *